US009746164B1

(12) United States Patent
Pan et al.

(10) Patent No.: US 9,746,164 B1
(45) Date of Patent: Aug. 29, 2017

(54) SUCTION LIGHTING SYSTEM

(71) Applicants: Ji Pan, Dallas, TX (US); Huang Ming, Beijing (CN)

(72) Inventors: Ji Pan, Dallas, TX (US); Huang Ming, Beijing (CN)

(73) Assignee: olighto, Inc., Dallas, TX (US)

( * ) Notice: Subject to any disclaimer, the term of this patent is extended or adjusted under 35 U.S.C. 154(b) by 0 days.

(21) Appl. No.: 15/019,823

(22) Filed: Feb. 9, 2016

(51) Int. Cl.

| | |
|---|---|
| ***F21L 4/00*** | (2006.01) |
| ***F21V 21/092*** | (2006.01) |
| ***F21S 9/02*** | (2006.01) |
| ***F21S 8/00*** | (2006.01) |
| ***F21V 23/00*** | (2015.01) |
| ***F21V 7/04*** | (2006.01) |
| *F21Y 101/02* | (2006.01) |

(52) U.S. Cl.
CPC ..... *F21V 21/092* (2013.01); *F21S 8/033* (2013.01); *F21S 9/02* (2013.01); *F21V 7/04* (2013.01); *F21V 23/003* (2013.01); *F21Y 2101/02* (2013.01)

(58) Field of Classification Search
CPC ..... F21V 21/092; F21V 7/04; F21V 23/003; F21S 8/033; F21S 9/02
USPC ..... 362/190
See application file for complete search history.

(56) References Cited

U.S. PATENT DOCUMENTS

| | | | | |
|---|---|---|---|---|
| 5,311,417 | A * | 5/1994 | Heh | A47G 33/00 362/249.11 |
| 5,491,621 | A * | 2/1996 | Duty | F21V 19/009 362/396 |
| 6,394,630 | B1 * | 5/2002 | Skidmore | F21S 9/02 315/360 |
| 6,398,388 | B1 * | 6/2002 | Lorenzana | A47G 33/06 362/240 |
| 6,648,492 | B1 * | 11/2003 | Shih | F21V 21/092 362/249.01 |
| 7,131,752 | B2 * | 11/2006 | Beveridge | B29C 35/0805 362/397 |
| D595,565 | S * | 7/2009 | Robertson | D8/354 |
| 8,231,261 | B2 * | 7/2012 | Gherardini | F21K 9/00 362/640 |
| D743,621 | S * | 11/2015 | Macias | D26/138 |
| 9,429,277 | B2 * | 8/2016 | Pearson | F21V 21/088 |
| 2002/0154512 | A1 * | 10/2002 | Shy | B60Q 1/302 362/503 |
| 2009/0103317 | A1 * | 4/2009 | Steck | B60Q 3/001 362/397 |
| 2013/0100658 | A1 * | 4/2013 | Pickard | F21S 8/02 362/230 |

* cited by examiner

*Primary Examiner* — Bryon T Gyllstrom
(74) *Attorney, Agent, or Firm* — Kirby B. Drake
Klemchuk LLP

(57) ABSTRACT

A lighting system includes a first light device having a housing; a suction means secured to a first end of the housing, the suction means being configured to removably secure the housing to a transparent structure; a light carried within the housing; and a power source conductively coupled to the light. The method includes securing the housing to the transparent structure; and directing light through the transparent structure with the light.

8 Claims, 4 Drawing Sheets

SUCTION LIGHTING SYSTEM

BACKGROUND

1. Field of the Invention

The present invention relates generally to display systems, and more specifically, to a removable lighting system for temporarily adhering lights to a smooth surface.

2. Description of Related Art

Lighting systems are well known in the art and are effective means to advertise information or create artistic displays. For example, FIG. 1 depicts a conventional lighting system 101 having a neon sign 103, a window 105, and a source of electricity 107. During use, the neon sign 103 is hung in the window 105 while the source of electricity 107 enables the sign 103 to illuminate.

One of the problems commonly associated with system 101 is its limited use. For example, the message of sign 103 is fixed and cannot be changed. Additionally manually creating light displays are time consuming, messy and difficult to reproduce.

Accordingly, although great strides have been made in the area of display systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
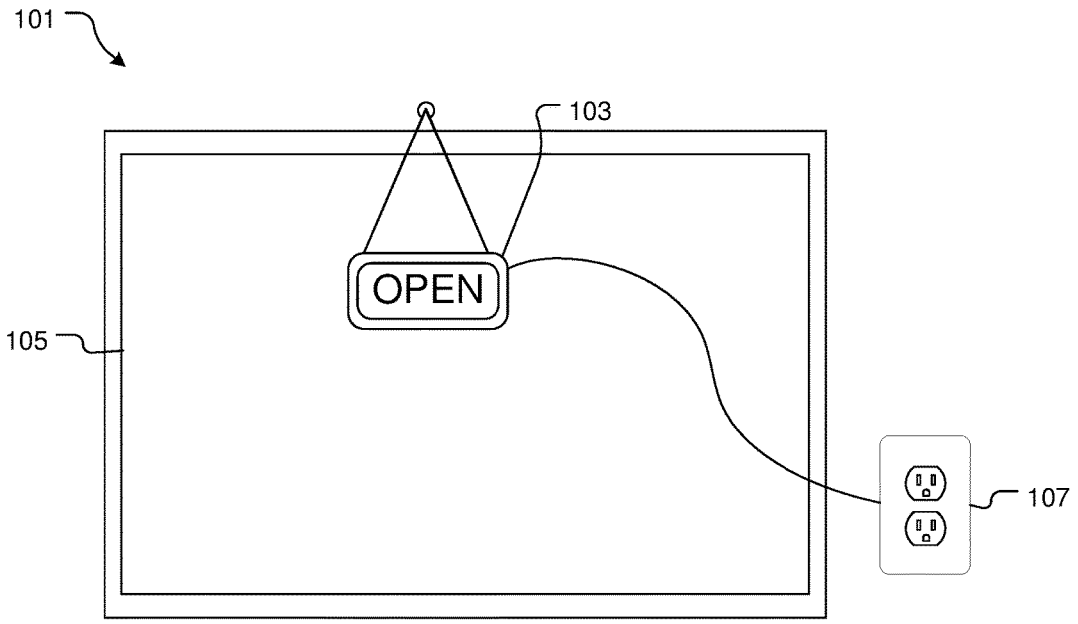
FIG. 1 (Prior Art)
FIG. 1 is a front view of a common display system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional display systems. Specifically, multiple components of a sign can individually adhere to smooth surfaces to allow for the message of the sign to be easily changed or reconfigured. In addition, there is no mess, and patterns can be easily reproduced. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
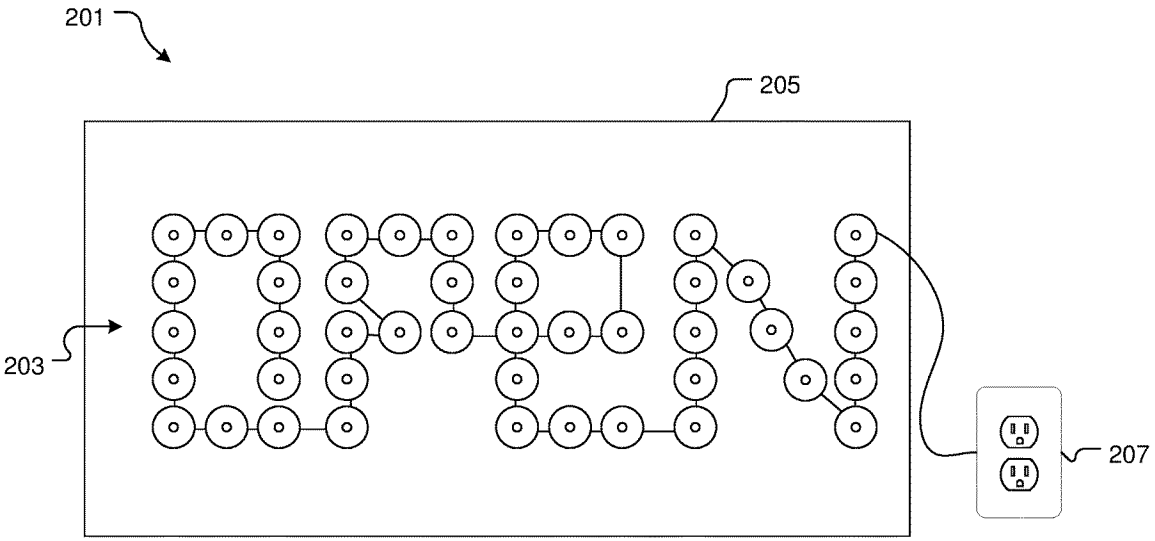
FIG. 2 is a front view of a suction lighting system in accordance with a preferred embodiment of the present application.

Referring now to the drawings wherein like reference characters identify corresponding or similar elements throughout the several views, FIG. 2 depicts a front view of a suction light system in accordance with a preferred embodiment of the present application. It will be appreciated that system 201 overcomes one or more of the above-listed problems commonly associated with conventional display systems.

In the contemplated embodiment, system 201 includes one or more suction light devices 203, one or more smooth surfaces 205, and one or more sources of electricity 207. In use the suction light devices 203 are attached to the smooth surface 205 via a vacuum created by the suction light devices 203, and then connected to the source of electricity 207 to power the light display.

It should be appreciated that one of the unique features believed characteristic of the present application is that each light 203 individually adheres to the smooth surface 205 to allow infinite varieties of displays to be created. Additionally it is contemplated that the individual components could be mechanically re-configured.

Figure 3:
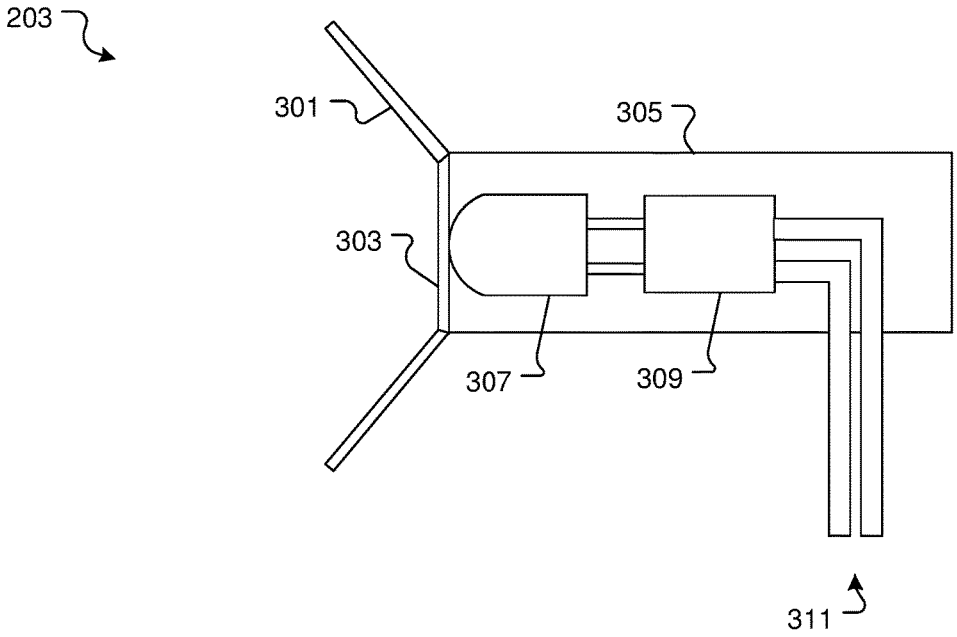
FIG. 3 is a sectional side view of the suction light of FIG. 2.

Referring now to FIG. 3 the suction light device 203 of FIG. 2 is depicted, the device comprising one or more suction means 301 with a transparent center 303 and a housing 305, and one or more light sources 307 in electronic communication with a signal receiving device 309 that is in electronic communication with a power input means 311. While the suction means 301 has been depicted as a suction cup, any other means of attaching a light to a surface via suction and any arrangement thereof is contemplated. It will be understood that the signal receiving device 309 receives signals that could change any aspect of the light produced by the light source 307.

Figure 4:
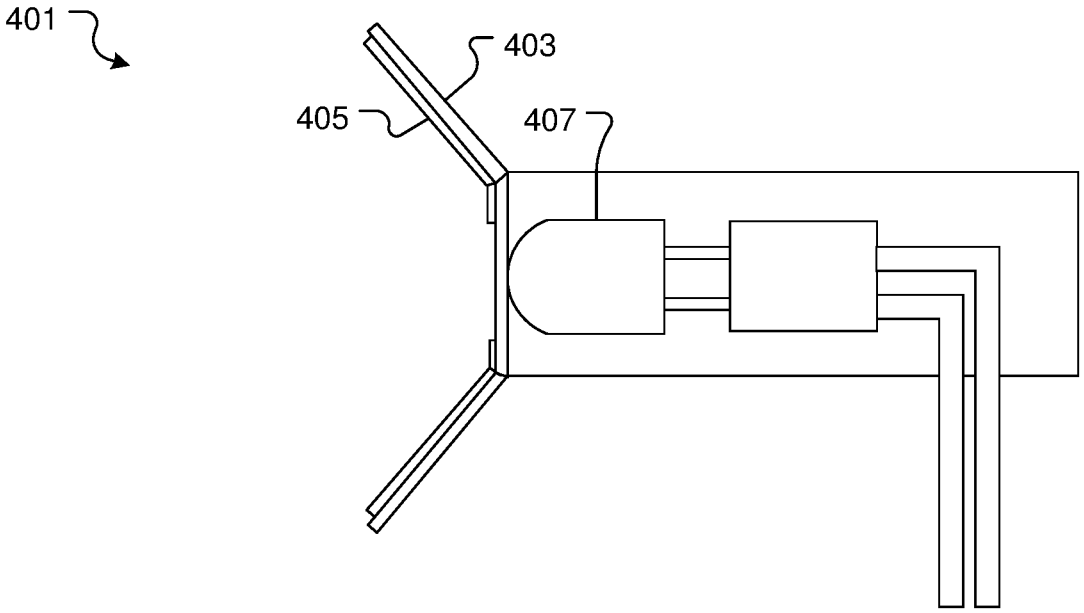
FIG. 4 is a sectional side view of an alternative embodiment of the suction light of FIG. 2.

Referring now to FIG. 4 an alternative embodiment of the suction light device 203 of FIG. 2 is depicted. In this embodiment 401 the suction means 403 is lined with a reflective material 405. It will be appreciate that this material increases the perceived intensity or brightness of the light source 407.

Figure 5:
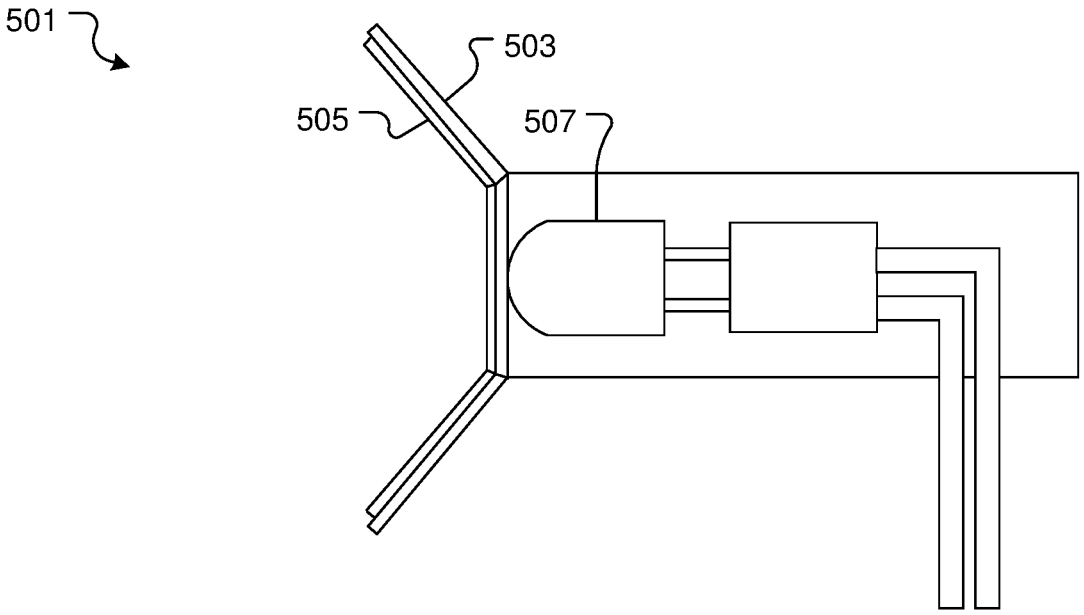
FIG. 5 is a sectional side view of another embodiment of the suction light of FIG. 2.

Referring finally to FIG. 5 another embodiment of suction light device 203 of FIG. 2 is depicted. In this embodiment 501 the suction means 503 is lined with tinted material 505. It will be also be appreciated that this lining modifies the color of the light from the light source 507. It is further contemplated that a lens of any type or tint could be applied to focus or disperse the light as well as change the color of the light.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A lighting system, comprising:

a first lighting device, having:

a first housing forming a first interior cavity;

a first suction means secured to an end of the first housing, the first suction means being configured to removably secure the first housing to a transparent structure, the first suction means having:

a first transparent center;

a first LED light carried within the first cavity of the first housing;

a first signal receiving device disposed within the first cavity and conductively coupled to the first LED light, the first signal receiving device being configured to change the characteristics of the first LED light;

wherein the first suction means is positioned between the first LED light and the transparent structure, thereby positioning the first transparent center in front of the first LED light;

a second lighting device, having:

a second housing forming a second interior cavity;

a second suction means secured to an end of the second housing, the second suction means being configured to removably secure the second housing to a transparent structure, the second suction means having:

a second transparent center a second LED light carried within the second cavity of the second housing;

a second signal receiving device disposed within the second cavity and conductively coupled to the first LED light, the second signal receiving device being configured to change the characteristics of the second LED light;

wherein the second suction means is positioned between the second LED light and the transparent structure, thereby positioning the second transparent center in front of the second LED light;

a power source conductively coupled to the first light and the second light;

wherein the first signal receiving device and the second signal receiving device are configured to change the characteristics of the first LED light and the second LED light independently;

wherein the characteristics include both color and intensity;

wherein the intensity of the first LED light and the second LED light have a range including one or more intensities between deactivated and fully activated;

wherein the power source provides electrical energy to the first light device and the second light device; and wherein the first light and second light illuminate through the transparent structure in a backlit fashion.

2. A method, comprising:

providing the lighting system of claim 1;

securing the first housing and the second housing to the transparent structure;

directing light through the transparent structure with the first LED light and the second LED light.

3. The method of claim 2, further comprising:

the first receiving signal device and the second receiving signal device receives signals that could change any aspect of the first LED light and the second LED light.

4. The system of claim 1, further comprising:

a reflective material secured to an inner surface of the first suction means, the inner surface being a surface that engages with the transparent structure.

5. The system of claim 1, further comprising:

a tinted material secured to an inner surface of the first suction means, the inner surface being a surface that engages with the transparent structure.

6. The system of claim 1, wherein the first suction means is a suction cup.

7. The system of claim 1, wherein the power source can be a battery.

8. The system of claim 1, wherein the transparent structure is a window.

* * * * *